US006502822B1

(12) United States Patent
Brown

(10) Patent No.: US 6,502,822 B1
(45) **Date of Patent: *Jan. 7, 2003**

(54) APPARATUS AND METHOD FOR CREATING A SEAL ON AN INNER WALL OF A TUBE FOR HYDROFORMING

(75) Inventor: James H. Brown, Westland, MI (US)

(73) Assignee: Aquaform, Inc., Auburn Hills, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/856,825

(22) Filed: May 15, 1997

(51) Int. Cl.[7] ..... F16L 17/00

(52) U.S. Cl. ..... 277/314; 72/58; 72/62; 29/281.3

(58) Field of Search ..... 72/57, 58, 61, 72/62; 29/239, 281.1, 281.3; 82/148; 277/314, 616, 625, 627; 285/382, 332, 382.4, 18; 138/94; 267/137

(56) References Cited

U.S. PATENT DOCUMENTS

| | | | | |
|---|---|---|---|---|
| 169,392 | A | 11/1875 | Wicks | 72/58 |
| 453,410 | A | 6/1891 | Langerfeld | 72/61 X |
| 567,518 | A | 9/1896 | Simmons | 72/57 |
| 588,804 | A | 8/1897 | Parish | 72/61 |
| 618,353 | A | 1/1899 | Huber | 72/61 |
| 693,172 | A | 2/1902 | Sneddon | 72/61 |
| 731,124 | A | 6/1903 | Park | 72/58 |
| 1,210,629 | A | 1/1917 | Foster | 72/61 |
| 1,389,348 | A | 8/1921 | Gulick | 72/61 |
| 1,448,457 | A | 3/1923 | Liddell | 72/61 |
| 1,542,983 | A | 6/1925 | Bergmann, Jr. | 72/58 |

(List continued on next page.)

FOREIGN PATENT DOCUMENTS

| | | | |
|---|---|---|---|
| CA | 1309239 | | 10/1992 |
| EP | 0414545 | A2 | 2/1991 |
| GB | 519593 | | 4/1940 |
| GB | 2162446 | A | 2/1986 |
| GB | 523948 | | 7/1990 |
| JP | 56-154228 | | 11/1981 |
| JP | 58-003738 | | 1/1983 |
| JP | 59-130633 | | 7/1984 |
| JP | 60015027 | | 1/1985 |
| JP | 60-082229 | | 5/1985 |
| SU | 549199 | | 7/1977 |

OTHER PUBLICATIONS

Payson, Peter. The Metallaurgy of Tool Steels. John Wiley & Sons, New York. p. 264, 1962.*

Declaration of Kevin Webb.

*Primary Examiner*—Anthony Knight
*Assistant Examiner*—Greg Binda
(74) *Attorney, Agent, or Firm*—Jenkens & Gilchrist

(57) ABSTRACT

A sealing unit capable of sealing engagement with an end of a tube. The tube has an outer wall and a bore surrounded by an inner wall. The seal unit comprises a tapered element having a longitudinal axis. The tapered element is adapted for insertion into the bore in the end of the tube. A sealing ring co-axial with said longitudinal axis of the tapered element to provide an annular channel between the tapered element and the sealing ring. The annular channel has an open end and a closed end. The annular channel is capable of receiving the end of the tube through the open end of the annular channel. A base, co-axial with the longitudinal axis of said tapered element, contacts the sealing ring to hold the sealing ring in place and contacts the tapered element to terminate the annular channel at the closed end. When the sealing unit is in sealing engagement with the end of the tube, the tapered element sealably engages the inner wall of the tube and the sealing ring sealably engages the outer wall of the tube.

52 Claims, 5 Drawing Sheets

U.S. PATENT DOCUMENTS

| | | | | | |
|---|---|---|---|---|---|
| 1,683,123 | A | | 9/1928 | Bergmann, Jr. | 72/61 |
| 1,879,009 | A | | 9/1932 | Anthony | 72/62 |
| 1,884,589 | A | | 10/1932 | Davies | 29/421.1 |
| 1,924,234 | A | * | 8/1933 | Faudi | 267/137 |
| 2,203,868 | A | | 6/1940 | Gray et al. | 72/58 |
| 2,342,858 | A | * | 2/1944 | Hansen | 72/57 |
| 2,652,121 | A | | 9/1953 | Kearns, Jr. et al. | 72/61 X |
| 2,707,820 | A | | 5/1955 | Reynolds | 72/57 |
| 2,713,314 | A | | 7/1955 | Leuthesser, Jr. et al. | 72/61 X |
| 2,734,473 | A | | 2/1956 | Reynolds | 72/62 |
| 2,748,455 | A | | 6/1956 | Draper et al. | 29/890.147 |
| 2,777,500 | A | | 1/1957 | Ekholm et al. | 72/57 |
| 2,841,865 | A | | 7/1958 | Jackson | 72/58 |
| 2,892,254 | A | | 6/1959 | Garvin | 72/58 X |
| 2,902,962 | A | | 9/1959 | Garvin | 72/58 X |
| 3,072,085 | A | | 1/1963 | Landis | 72/58 |
| 3,077,170 | A | | 2/1963 | Parlasca | 29/421.1 |
| 3,105,537 | A | | 10/1963 | Foster | 72/57 |
| 3,136,053 | A | | 6/1964 | Powell | 72/57 |
| 3,151,590 | A | | 10/1964 | Garvin | 72/61 |
| 3,160,130 | A | | 12/1964 | Pesak | 72/61 X |
| 3,220,098 | A | | 11/1965 | Arbogast | 72/57 X |
| 3,247,581 | A | | 4/1966 | Pellizzari | 72/62 X |
| 3,303,680 | A | | 2/1967 | Thielsch | 72/58 |
| 3,328,996 | A | | 7/1967 | Pin et al. | 72/301 |
| 3,487,668 | A | | 1/1970 | Fuchs, Jr. | 72/55 |
| 3,505,846 | A | | 4/1970 | Smida | 72/61 |
| 3,535,901 | A | | 10/1970 | Tominaga | 72/61 |
| 3,550,491 | A | | 12/1970 | Wingard | 83/22 |
| 3,613,423 | A | | 10/1971 | Nakamura | 72/58 |
| 3,654,785 | A | | 4/1972 | Ueda et al. | 72/28 |
| 3,701,270 | A | | 10/1972 | Matthews | 72/57 |
| 3,739,615 | A | | 6/1973 | Tressel | 72/57 |
| 3,763,681 | A | | 10/1973 | Flintoft | 72/57 |
| 3,768,288 | A | | 10/1973 | Jury | 72/61 |
| 3,808,860 | A | | 5/1974 | Yamaguchi et al. | 72/60 |
| 3,813,751 | A | | 6/1974 | Smida | 29/727 |
| 3,946,584 | A | | 3/1976 | Yamasaki | 72/60 |
| 3,974,675 | A | | 8/1976 | Tominaga | 72/56 |
| 4,125,937 | A | | 11/1978 | Brown et al. | 29/727 |
| 4,189,162 | A | | 2/1980 | Rasmussen et al. | 279/4.06 |
| 4,238,878 | A | | 12/1980 | Stamm et al. | 29/421.1 |
| 4,319,471 | A | | 3/1982 | Benteler et al. | 72/59 |
| 4,457,498 | A | * | 7/1984 | Pauliukonis | 267/137 X |
| 4,484,756 | A | | 11/1984 | Takamiya et al. | 280/281.1 |
| 4,485,653 | A | | 12/1984 | Rasmussen | 72/58 |
| 4,485,654 | A | | 12/1984 | Rasmussen | 72/58 |
| 4,567,743 | A | | 2/1986 | Cudini | 72/61 |
| 4,704,886 | A | | 11/1987 | Evert et al. | 72/57 |
| 4,706,365 | A | * | 11/1987 | Hooton | 285/382 X |
| 4,730,474 | A | | 3/1988 | Iwakura et al. | 72/61 |
| 4,744,237 | A | | 5/1988 | Cudini | 72/367 |
| 4,759,111 | A | | 7/1988 | Cudini | 29/523 |
| 4,761,982 | A | | 8/1988 | Snyder | 72/58 |
| 4,788,843 | A | | 12/1988 | Seamann et al. | 72/58 |
| 4,803,878 | A | | 2/1989 | Moroney | 72/296 |
| 4,815,308 | A | | 3/1989 | Moroney | 72/296 |
| 4,827,747 | A | | 5/1989 | Okada et al. | 72/59 |
| 4,829,803 | A | | 5/1989 | Cudini | 72/367 |
| 4,840,053 | A | | 6/1989 | Nakamura | 72/58 |
| 5,070,717 | A | | 12/1991 | Boyd et al. | 72/55 |
| 5,107,693 | A | | 4/1992 | Olszewski et al. | 72/58 |
| RE33,990 | E | | 7/1992 | Cudini | 72/367 |
| 5,170,557 | A | | 12/1992 | Rigsby | 29/890.08 |
| 5,203,190 | A | | 4/1993 | Kramer et al. | 72/62 |
| 5,233,854 | A | | 8/1993 | Bowman et al. | 72/58 |
| 5,233,856 | A | | 8/1993 | Shimanovski et al. | 72/62 |
| 5,235,836 | A | | 8/1993 | Klages et al. | 72/62 |
| 5,239,852 | A | | 8/1993 | Roper | 72/58 |
| 5,279,142 | A | | 1/1994 | Kaiser | 72/61 |
| 5,321,964 | A | | 6/1994 | Shimanovski et al. | 72/62 |
| 5,333,775 | A | | 8/1994 | Bruggemann et al. | 72/61 X |
| 5,339,667 | A | | 8/1994 | Shah et al. | 72/58 |
| 5,353,618 | A | | 10/1994 | Roper et al. | 72/58 |
| 5,363,544 | A | | 11/1994 | Wells et al. | 72/58 X |
| 5,481,892 | A | | 1/1996 | Roper et al. | 72/61 |
| 5,499,520 | A | | 3/1996 | Roper | 72/58 |
| 5,715,718 | A | * | 2/1998 | Rigsby et al. | 72/57 |
| 6,006,567 | A | * | 12/1999 | Brown et al. | 72/58 |

* cited by examiner

APPARATUS AND METHOD FOR CREATING A SEAL ON AN INNER WALL OF A TUBE FOR HYDROFORMING

BACKGROUND OF THE INVENTION

1. Field of the Invention

The present invention relates generally to a sealing unit for sealing the end of a blank tube and, more particularly, to a sealing unit for sealing the end of a tube in a hydroforming station.

2. Description of the Related Art

Industry requires standard tubular blanks to be formed into one-piece, complex tubular shapes. In the automobile industry, automobile frames are typically of the "box" type construction for strength and load bearing purposes. These frame members often have a great variation in both the horizontal and vertical profile. The cross-section of such members often varies rather extremely from approximately a square cross-section, to a rectangular cross-section to a round cross-section to a severely flattened cross-section, and to any irregularly shaped combination of the above. The same is true for the antenna industry, which requires a wide variety of cross-section shapes for waveguides.

An apparatus that forms the desired one-piece, complex tubular shapes from tubular blanks is a hydroforming station or hydroforming press. The hydroforming station follows a series of steps to form the desired tubular shape. First, a blank tube or workpiece is placed between a pair of dies having cavities defining the desired resultant shape of the formed tube. The ends of the workpiece are tightly sealed with a pair of sealing units. The workpiece is filled with fluid which is then pressurized. Pressurizing the fluid within the workpiece results in forming and expanding the tube to conform to the cavity shape. The fluid is drained from the tube and the sealing units are removed to release the formed frame.

Conventional sealing units implement a flexible gasket, resilient elastomeric annular seal or O-ring. Typically, the O-ring relies on contact with the external surface of the tube to maintain a fluid seal. In some applications, especially low pressure hydroforming below 5000 pounds per square inch, the conventional O-ring sealing unit may perform adequately. However, at higher hydroformning pressures above 5000 pounds per square inch, the conventional O-ring sealing units do not perform adequately. Even at the low pressure hydroforming, the O-ring sealing unit has some shortcomings. The main shortcoming of the conventional sealing unit is that it tends to be the first part of the hydroforming press to fail. Because workpieces are unfinished, they often have burrs on the edges of their openings. The repetitive motion of the O-ring over these burrs on multiple workpieces damage the O-rings. Additionally, constant friction between the O-ring and workpieces wear down the gasket material. Repeated use of the sealing units results in the necessity of frequent replacement of the O-rings. Constant replacement of the O-rings results in large maintenance costs and large inefficient down times.

For the hydroforming station to properly function, the sealing units must maintain a tight fluid seal. For high pressure hydroforming, the O-ring sealing units, especially worn O-rings, may fail to maintain a tight fluid seal. Failure of the O-ring in conventional sealing units results in leaking and non-functioning hydroforming press. Even worse, an O-ring failure could result in great harm to machine operators or adjacent machinery. The release of the highly pressurized fluid could result in death and destruction. Conventional hydroforming presses with their O-ring implementing sealing units require some form of machine guard or personal protection. These additional safety precautions resulting in added costs and obstructed views.

The present invention is directed to overcoming or at least reducing the effects of, one or more of the problems set forth above.

SUMMARY OF THE INVENTION

In accordance with one aspect of the present invention, there is provided a sealing unit capable of sealing engagement with an end of a tube. The seal unit comprises a tapered element, a sealing ring and a base. The tapered element having a longitudinal axis is adapted for insertion into a bore in the end of the tube. The sealing ring is co-axial with the longitudinal axis of the tapered element providing an annular channel between the tapered element and the sealing ring. The annular channel is capable of receiving the end of the tube. The base, being co-axial with the longitudinal axis of the tapered element, contacts the sealing ring holding it in place. The base also contacts the tapered element terminating the annular channel. When the sealing unit sealably engages the end of the tube, the tapered element sealably engages the inner wall of the tube, and the sealing ring sealably engages the outer wall of the tube.

In accordance with another aspect of the present invention, there is provided a sealing unit capable of sealing engagement with an end of a tube. The sealing unit further comprises a housing and at least one stop element. The base has a front end and a back end. Proximate to the back end of the base is the housing, and the housing is connected to the tapered element. The stop element is positioned between the housing and the sealing base. When the end of the tube is positioned within the annular channel, and the base is stationary relative to the tube, the housing is capable of sliding toward said back end of said stationary base compressing the stop element. The tapered element, being connected to the housing, is capable of sliding further into the bore until the tapered element sealably engages the inner wall of the tube. When the tapered element is in sealable engagement with the inner wall of the tube, the tapered element forces the inner wall of the tube outward providing sealable engagement between the outer wall of the tube and the sealing ring.

In accordance with a further aspect of the present invention, there is provided a sealing unit capable movement between a sealed position and a retracted position. The sealing unit comprises a sealing unit moving means capable of moving the sealing unit between the retracted position and the sealed position. The sealing unit moving means is connected to the housing. In the retracted position, the sealing unit is positioned away from the end of the tube. In the sealed position, the sealing unit sealably engages the end of the tube.

BRIEF DESCRIPTION OF THE DRAWINGS

The foregoing and other advantages of the invention will become apparent upon reading the following detailed description and upon reference to the drawings which.

Figure 1:
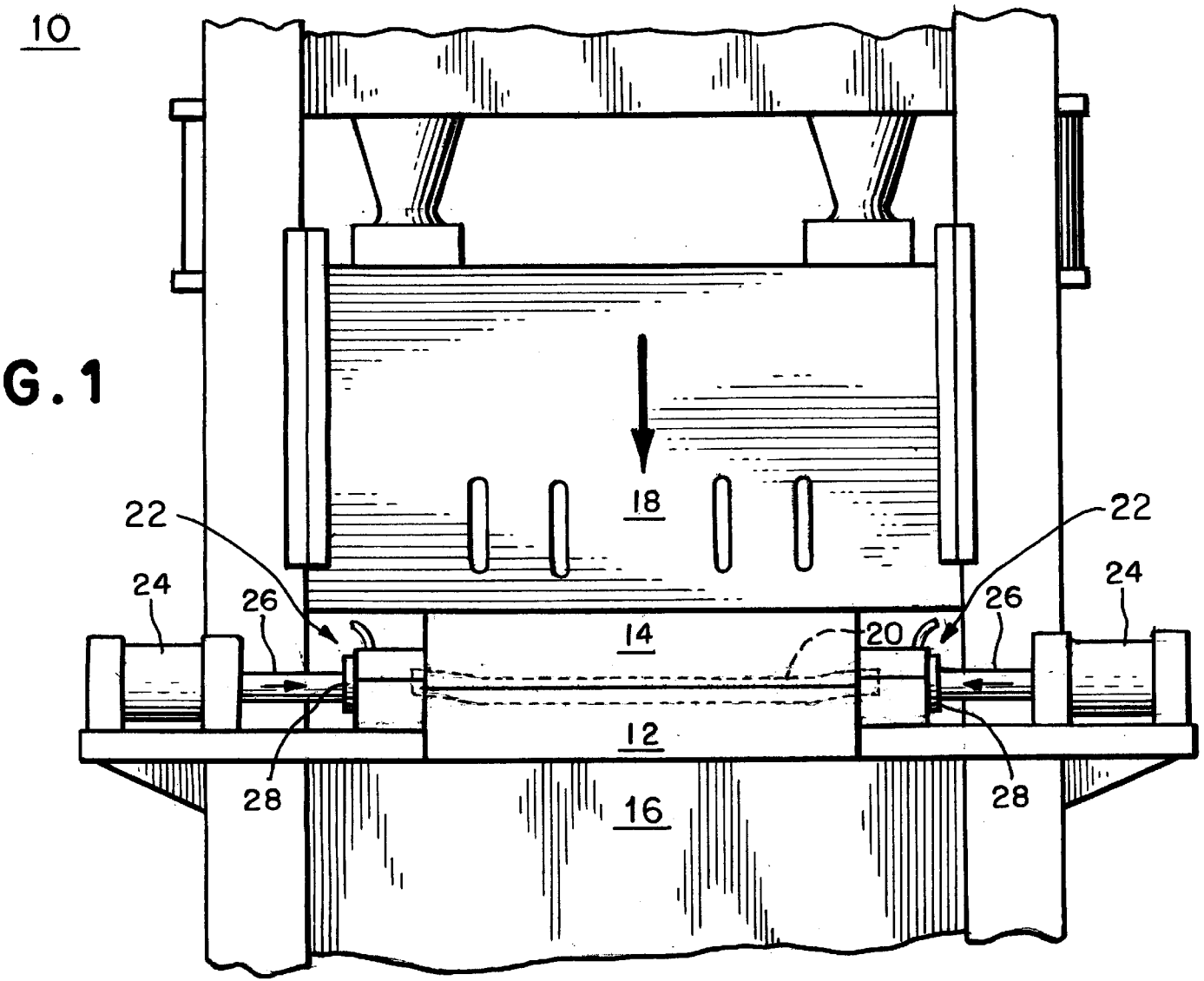
FIG. 1 is a side elevation view of a hydroforming station.

While the invention is susceptive to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the appended claims.

DETAILED DESCRIPTION OF THE INVENTION

Surprisingly, it has been discovered that an end of a tube can be efficiently sealed with a sealing unit in accordance with the present invention. The sealing unit of the present invention has been found to tightly fluid seal the end of a tube in a hydroforming station. The sealing unit of the present invention does not employ O-rings, and the sealing unit can maintain a tight fluid seal at operating pressures in the range of 5000 to 30000 pounds per square inch at which O-rings fail to perform adequately. Because the elements of the sealing unit are preferably a hardened metal, the sealing unit of the present invention can endure repeated frictional contact with ends of tubes with minimum wear. Moreover, the sealing unit can be efficiently and inexpensively operated and maintained on a hydroforming station.

The present invention works with a hydroforming station. The hydroforming station is an apparatus that forms complex tubular shapes from a blank tube. Generally, a hydroforming station includes a lower die, an upper die mounted on a ram press, and a pair of sealing units. To form the complex shaped tube, an operator places a blank tube onto a lower die cavity in the lower die of the hydroforming station. The upper die is lowered to a set point above the lower die. The upper die has an upper die cavity aligned with the lower die cavity. At the set point, the upper die cavity does not contact the blank tube. With the upper die at the set point, the sealing units of the present invention move from a retracted position to a sealed position. In the retracted position, the sealing units are positioned away from the ends of the tube. In the sealed position, the sealing units sealably engage the ends of the tube providing a tight fluid seal.

Once the sealing units of the present invention are in the sealed position, a forming fluid fills the tube. To prevent the tube from collapsing when the upper die and lower die mate, the pressure of the forming fluid in the tube is increased to a low pressure range. Increasing the pressure of the forming fluid to the low pressure range provides a liquid mandrel to prevent the tube from collapsing. The low pressure range is dependent upon the material of the blank tube. The low pressure range is a range of pressure greater than the pressure which would prevent the tube from collapsing upon itself when the dies mate and less than the yield point pressure which would expand the tube. In normal operation, the low pressure range is between 500 to 1200 pounds per square inch. The sealing units of the present invention maintain a tight fluid seals on the ends of the tube when the pressure in the tube is in the low pressure range.

Once the fluid pressure within the tube is at the low pressure range, the upper die lowers to mate with the lower die. When the upper and lower dies mate, the upper and lower die cavities join to form the forming cavity. The forming cavity represents the desired cross-sectional shape of the formed tube. After the lower and upper dies mate, the pressure in the tube increases to a high pressure range. The high pressure range is a pressure sufficiently high to expand the tube to fill the recesses of the forming cavity which is dependent on the material of the blank tube. The high pressure range is a range of pressure greater than the yield point pressure which would expand the tube into the recesses of the forming cavity and less than the yield point pressure of the dies and sealing units. In normal operation, the high pressure range is between 3000 to 10000 pounds per square inch. The sealing units of the present invention maintain tight fluid seals on the ends of the tube for high pressure in the range between 3000 to 30000 pounds per square inch.

By increasing the pressure of the forming fluid to the high pressure range, the tube expands into the recesses of the forming cavity. After the tube has been expanded, the pressure on the forming fluid is removed, and the forming fluid is drained from the formed tube. The sealing units of the present invention retract to the retracted position, and the upper die is raised to allow the formed tube to be removed from the hydroforming press.

The above described steps for hydroforming may be modified. The sealing unit of the present invention also works on any hydroforming station following any modification in the hydroforming method. An alternative method contemplated would be to immediately lower the upper die to mate with the lower die. In this method, the tube would collapse between the upper and lower die cavities. The sealing units of the present invention would then seal the ends of the tube, and forming fluid would be delivered to the tube. To expand the tube to the recesses of the forming cavity and to remove the wrinkles from the collapsed tube, the forming fluid pressure would have to be increased to a pressure greater than the pressure required to form the tube without the collapse.

The present invention is directed to the sealing units for any hydroforming station which requires sealing the ends of a tube. The sealing units move between the retracted position and the sealed position. A sealing unit moving means provides the needed translation between the retracted position and the sealed position. The sealing unit moving means may be a hydraulic cylinder assembly with a piston arm connected to the sealing unit. Other moving means includes a screw and motor combination or other equivalents.

The sealing unit of the present invention comprises a tapered element, a sealing ring and a base. The tapered element has a longitudinal axis aligned with the longitudinal axis of the tube positioned in the lower die cavity. The tapered element is adapted for insertion into the bore of the tube. The tapered element has a insertion end with an insertion diameter and a housing end with a sealing diameter. The insertion diameter is smaller than the inner diameter of the tube to facilitate easy insertion of the tapered element into the bore of the tube. The sealing diameter of the tapered element is larger than the inner diameter of the tube to provide tight seal between the tapered element and the inner wall of the tube. and to force the wall of the tube outward. The tapered element may have any shape which provides a taper from the insertion diameter to the sealing diameter. Examples of suitable shapes include a paraboloid, a frustum of a paraboloid, a right circular cone, and a frustum of a right circular cone.

The sealing unit of the present invention further includes the sealing ring. The sealing ring is co-axial with the longitudinal axis of the tapered element to provide an annular channel between the tapered element and the sealing ring. The annular channel has an open end and a closed end. The open end of the annular channel is adapted to receive the end of the tube.

The sealing ring may have a uniform inner diameter equal to or slightly larger than the outer diameter of the tube. Providing the sealing ring with an inner diameter at the open end of the annular channel slightly larger than the outer diameter of the tube allows the end of the tube to easily slide into the open end of the annular channel. The inner diameter of the sealing ring may be approximately five thousandths of an inch larger than the outer diameter of the tube. The inner diameter of the sealing ring may taper to match the taper of the tapered element to maintain a uniform annular channel, or the inner diameter of the sealing ring could taper in a direction opposite to the taper of the tapered element to provide an annular channel with a decreasing width from the open end to the closed end.

The base of the sealing unit contacts the sealing ring and the tapered element to hold the sealing ring in place and to terminate the annular channel at its closed end. The base is co-axial with the longitudinal axis of the tapered element. The base may be composed of one unitary part or several parts. Additionally, the base and the sealing ring could be joined to be a single component; however, having a separate base and sealing ring allows a worn sealing ring to be replaced or interchanged while continuing to use the base elements.

When the sealing unit is moved from the retracted position to the sealed position, the tapered element enters the bore of the tube, and the end of the tube enters the open end of the annular channel. The sealing unit moves toward the end walls of the upper and lower die until the base abuts those walls. When the base abuts the end walls of the lower and upper die, the base and sealing ring can move no further; however, the tapered element is capable of sliding further into the bore of the tube relative the sealing ring and base. The tapered element slides further into the bore of the tube until the tapered element sealably engages the inner wall of the tube. The present invention provides for the tapered element sliding future into the tube with the sealing ring stationary. The sealing ring could be held stationary by another manner than the base abutting the end walls of the lower and upper dies. Additionally, the tapered element and sealing ring could provide the their tight fluid seals without requiring the tapered element to slide further into the tube with the sealing ring remaining stationary.

When the tapered element sealably engages the inner wall of the tube, the tapered element forces the wall of the tube outward against the sealing ring. Because sealing diameter of the tapered element is larger than the inner diameter of the tube, not only does the tapered element provide for a tight seal between the tapered element and the inner wall of the tube, but the tapered element also forces the wall of the tube outward closing any gap between the sealing ring and the outer wall of the tube providing a tight seal between the sealing ring and the outer wall of the tube.

The tapered element and sealing ring are preferably composed of a hardened steel such as D2 steel which is a hardened tool steel. Because the sealing ring and tapered element repeatedly endure frictional contact with blank tubes, the tapered element and sealing ring are preferably composed of material harder than the material of the tubes to reduce wear on the tapered element and sealing ring. Any material stronger than the material of the blank tubes would reduce the wearing effects of repeated sealing by the sealing units. The base is preferably composed of a cheaper, boilerplate steel because of its limited frictional contact with the blank tubes. Portions of the base that repeatedly contact the end walls of the upper and lower dies are preferably made of a hardened steel such as D2 steel.

Because the sealing units are part of a hydroforming station, the sealing units must not only tightly seal the ends of the tube, but also must provide a means of introducing forming fluid into the tube. The tapered element has a central fluid passage along its longitudinal axis to provide a passage for forming fluid into the tube. The central fluid passage is connected to a fluid supply chamber which controls the passing and pressurizing of the forming fluid into the tube.

The sealing unit of the present invention may further comprise a housing and at least one stop element. The housing provides a foundation for the sealing unit. The sealing unit moving means connects to the housing to move the housing and the other elements of the sealing unit. The housing may be a cube, cylinder or any shape. The housing end of the tapered element is connected to the housing. The base of the sealing unit has a front end and a back end. The housing is separated from the back end of the base by the stop elements which biases the base away from the housing. The stop elements may be any compressible material such as a rubber spring manufactured by the Lamina Company or an air piston such as a nitrogen piston. The stop elements may be any shape such as disks or cubes and may be arranged in any manner between the housing and the back of the base such that they bias the base away from the housing.

When the end of the tube is positioned within the annular channel and the base and sealing ring are stationary, the housing is capable of sliding toward the base compressing the stop elements, at the same time the tapered element further enters the bore of the tube until sealably engages the inner wall of the tube.

When the sealing unit is in the sealed position, the tube may be filled with the highly pressurized forming fluid. The sealing unit moving means holds the sealing unit in place against the force of the pressure, so the tapered element may not retreat from its sealed engagement with the inner wall of the tube.

Once the tube has been formed, the forming fluid is drained from the tube and the sealing units may be moved to the retracted position. The sealing unit moving means pulls the tapered element from its sealable engagement with the inner wall of the tube. To aid in removing the sealing unit, the base is connected to the housing by a spool retainer. The spool retainer has a housing end and a base end. The housing end of the spool retainer is connected to the housing, and the base end of the spool retainer is moveable within a spool retainer chamber in the base. The spool retainer limits the amount the tapered element may move relative to the base and the sealing ring. When the sealing unit moving means retracts the housing, the spool retainer moves within the spool retainer chamber until its base end abuts the wall of the chamber. When the spool retainer abuts the wall of the spool retainer chamber, the sealing unit moving means pulls the sealing ring from its sealable engagement with the outer wall of the tube. The base may be connected to the housing and in turn to the sealing unit moving means in any fashion to allow the sealing ring to be removed from engagement with the outer wall of the tube.

DESCRIPTION OF ILLUSTRATIVE EMBODIMENTS

Turning now to the drawings, FIG. 1 illustrates an apparatus 10 for forming complex shaped frame members known as a hydroforming station or hydroforming press. The station 10 has a pair of sealing units 22, a lower die 12 mounted on a lower die bed 16, and an upper die 14 mounted to a ram press 18. The hydroforming station 10 has an open position and a forming position. In the open position, the sealing units 22 are in a retracted position away from the ends of the blank tube 20. In the open position, an open space separates the upper die 14 from the lower die 12 allowing a blank tube 20 to be placed into a cavity in the lower die 12. To move to the forming position illustrated in FIG. 1, the ram press 18 lowers the upper die 14 lower to a set point above the lower die 12. At this point, the blank tube 20 is secured between the cavity of the lower die 12 and a cavity of the upper die 14. The pair of sealing units 22 engage the ends of the tube 20 providing a tight fluid seal at the ends of the tube 20. To prevent the tube 20 from collapsing between the upper and lower dies 14 and 12, a forming fluid is delivered into the tube 20 through the sealing units 22. After the forming fluid has filled the tube 20 and the fluid pressure has been increased to a level to prevent collapse of the tube 20, the ram press 18 further lowers the upper die 14 to mate with the lower die 12 placing the hydroforming station in the forming position.

The joined cavity of the lower and upper die 12 and 14 represents the desired shape of the formed tube. To form the blank tube 20 into the formed tube, the forming fluid in the tube 20 is highly pressurized to a pressure above the yield point of the tube to expand the blank tube 20 into the regions of the die cavity. After the formed tube has been created, the sealing units 22 drain the forming fluid from the formed tube and retract to release the formed tube. The ram press 18 moves away from the lower die 12 allowing the formed tube to be removed from the hydroforming station 10 and for the process to be repeated. The ends of the formed tube are cropped to form the finished frame.

Figure 2A:
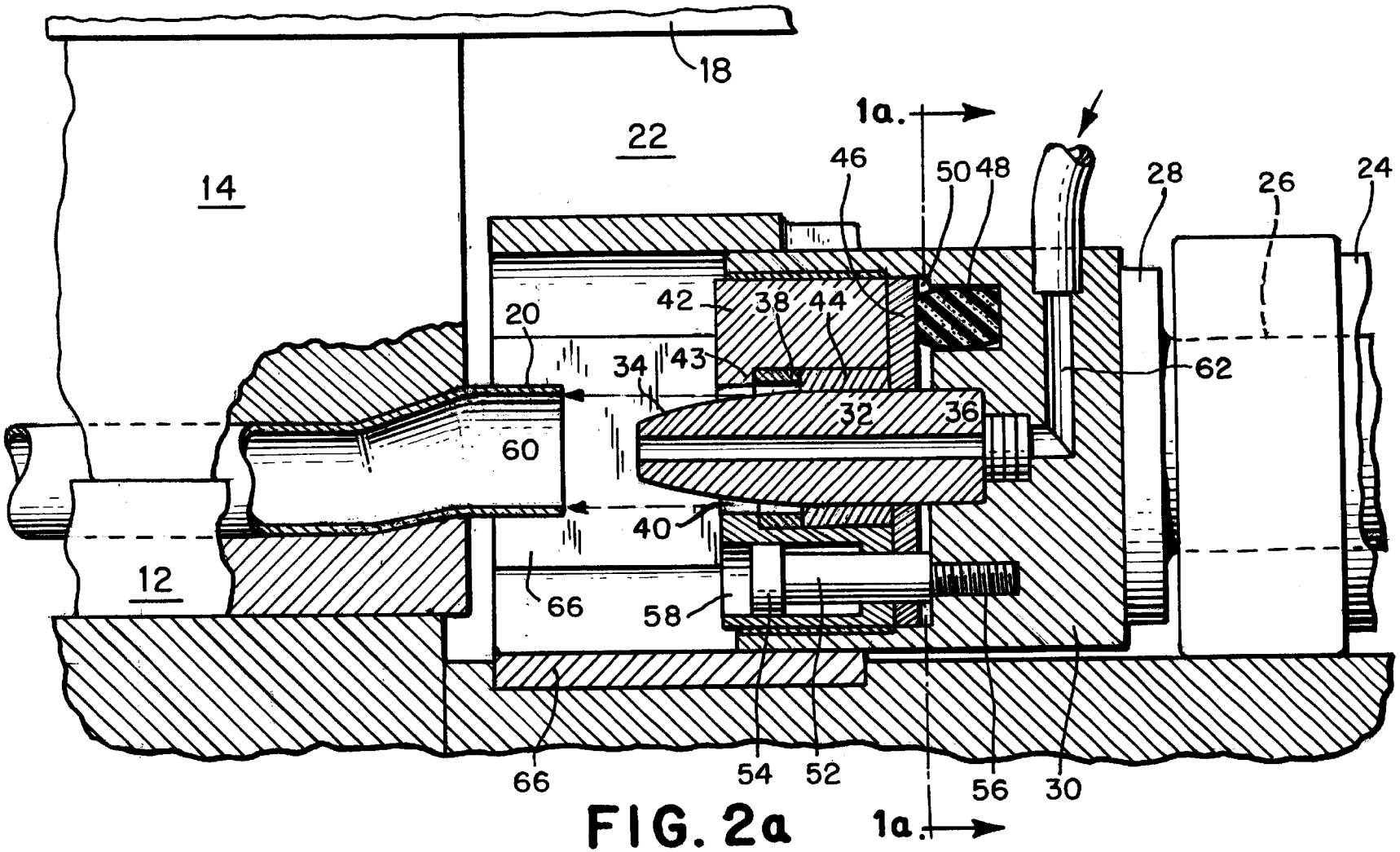
FIG. 2*a* is a side elevation view of the preferred embodiment of a sealing unit in a retracted position.
Figure 2C:
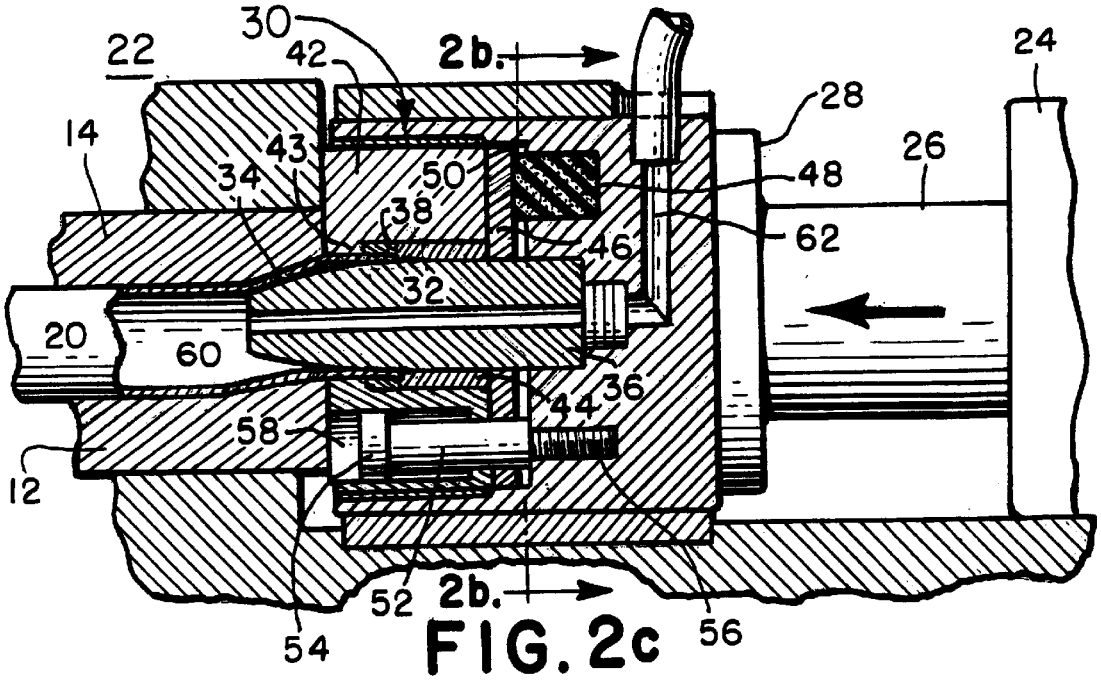
FIG. 2*c* is a side elevation view of the sealing unit in FIG. 2*a* in transition to a sealed position.
Figure 2B:
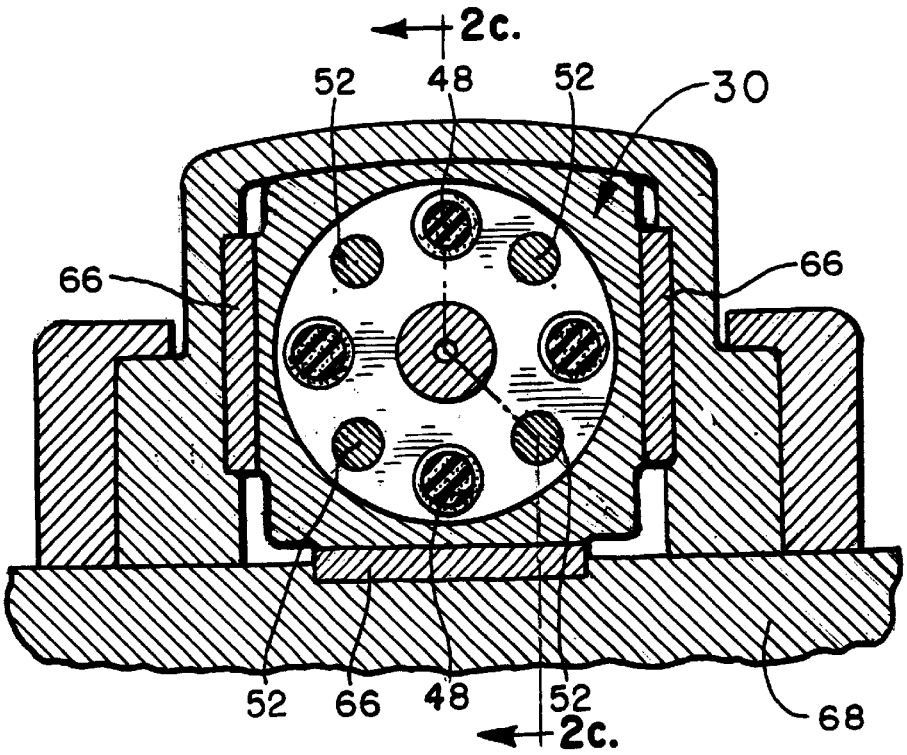
FIG. 2*b* is a end view of the embodiment of the sealing unit in FIG. 2*a* along line 1*a*—1*a*.
Figure 2D:
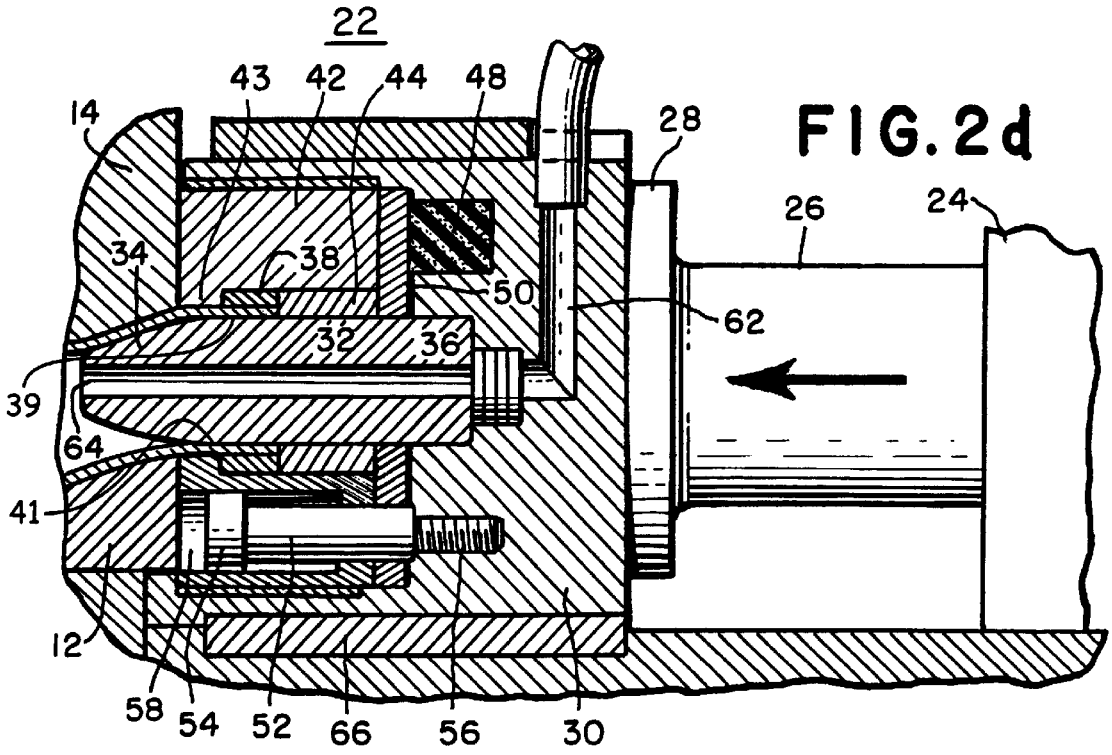
FIG. 2*d* is a side elevation view of the sealing unit in FIG. 2*a* in the sealed position.

FIG. 2*a* through 2*d* illustrate the currently preferred embodiment for the sealing unit 22 of the hydroforming station 10. FIG. 2*a* illustrates the sealing unit 22 in the retracted position; FIG. 2*c* illustrates the sealing unit 22 in transition to a sealed position; and FIG. 2*d* illustrates the sealing unit in the sealed position. A hydraulic cylinder assembly 24 with its outwardly extending piston rod 26 moves the sealing unit 22 between the retracted position and the sealed position. For the hydraulic cylinder assembly 24 to control the position of the sealing unit 22, a connecting plate 28 connects the piston rod 26 to the sealing unit 22. An appropriate hydraulic pressure source (not shown) drives the hydraulic cylinder assembly 24 to control the motion of the piston rod 26.

FIG. 2*a* illustrates the sealing unit 22 in the retracted position. The housing 30 is the foundation for the sealing unit 22. Connected to the housing 30 is a tapered element 32. The tapered element 32 of FIG. 2*a* is a paraboloid with its top removed. The tapered element 32 has an insertion end 34 and a housing end 36. In the preferred embodiment, the housing end 36 of the tapered element 32 screws into the housing 30. Any removable connecting means known in the art could be used to connect the tapered element 32 to the housing 30. The tapered element 32 tapers from a insertion diameter at the insertion end 34 to a sealing diameter at the housing end 36. The sealing diameter may be any diameter larger than the inner diameter of the tube 20 in order to provide a sealing engagement with the inner wall of the tube 20. To guide end of the tube 20 over the tapered element 32, the insertion diameter has a smaller diameter than the inner diameter of the tube 20.

Co-axial to the longitudinal axis of the tapered element 32 is a sealing ring 38. (The longitudinal axis is in the direction represented by the arrows in FIG. 2*a*). In the preferred embodiment, the sealing ring 38 has an uniform inner diameter equal to or slightly larger than the outer diameter of the tube 20. The tolerance of the inner diameter of the sealing ring 38 can be approximately five thousandths of an inch larger than the outer diameter of the tube 20. The sealing ring 38 defines an annular channel 40 with an open end and a closed end.

The sealing unit 22 in FIG. 2*a* further includes a base. The base is co-axial to the longitudinal axis of the tapered element 32 and holds the sealing ring 38 in place. As illustrated in FIG. 2*a*, the sealing base comprises three elements: a pad element 42, a locating element 44 and a backing plate 46. In the preferred embodiment, the sealing base elements abutted together without being fixed to each other. The pad element 42 encircles the sealing ring 38 and has a flange 43 to hold the sealing ring 38 in place. The locating element 44 abuts the sealing ring 38 further holding the sealing ring 38 in place. The back plate 46 abuts the pad element 42 and locating element 44 holding them in place. A spool retainer 52 connects the base to the housing 30. The spool retainer 52 has a pad end 54 and a housing end 56. In the preferred embodiment, the housing end 56 of the spool retainer 52 screws into the housing 30. For the preferred embodiment, any removable connecting means known in the art could be used to connect the spool retainer 52 to the housing 30. The pad end 54 of the spool retainer 52 is moveable within a spool retainer chamber 58 within the pad element 42.

Separating the backing plate 46 from the housing 30 is a stop element 48. In the preferred embodiment, the stop element is a rubber spring 48 sold by the Lamina Company. FIG. 2*b* illustrates the arrangement for the rubber springs 48. In the preferred embodiment, four disk shaped rubber springs 48 are equally spaced along the housing 30. The rubber springs 48 bias the backing plate 46, pad element 42, locking element 44, and sealing ring 38 away from the housing 30 creating a compression gap 50 between the housing 30 and the backing plate 46. FIG. 2*b* also illustrates the arrangement of four spool retainers 52.

FIG. 2*c* illustrates the sealing unit 22 in transition from the retracted position to the sealed position. To move the sealing unit 22 from the retracted position to the sealed position, the hydraulic cylinder assembly 24 extends the piston arm 26 moving the sealing unit 22 toward the end of the tube 20 contained between the lower and upper dies 12 and 14. The hydraulic cylinder assembly 24 pushes the insertion end 34 of the tapered element 32 into the bore 60. The small insertion diameter of the insertion end 34 guides the tube 20 over the tapered element 32. With the diameter of the tapered element 32 increasing from the insertion diameter to the sealing diameter, the tapered element 32 guides the end of the tube 20 into the open end of the annular channel 40.

As illustrated in FIG. 2*c*, the end of the tube 20 moves further into the annular channel 40 until end of the tube reaches the closed end of the annular channel 40. When the end of the tube 20 reaches the closed end of the annular channel 40, the pad element 42 abuts the ends of the lower and upper dies 12 and 14 and the end of the tube 20 abuts the locating element 44. Because the pad element 42 abuts the ends of the upper and lower dies 14 and 12, the pad element 42, the locating element 44, sealing ring 38 and backing plate 46 can not advance any further relative to the end of the tube 20.

FIG. 2*c* illustrates the locating element 44 abutting the end of the tube 20 at the same time the pad element 42 abuts the ends of the lower and upper dies 12 and 14. If the pad element 42 abuts the ends of the lower and upper dies 12 and 14 prior to the end of the tube 20 abutting the locating element 44, the pad element 42, the locating element 44 sealing ring 38 and backing plate 46 can not advance any further relative to the end of the tube 20. If the locating element 44 abuts the end of the tube 20 prior to the pad element 42 abutting the ends of the lower and upper dies 12 and 14, the locating element 44 will push on the end of the tube 20 to centrally locate the tube within the die cavity until the pad element 42 contacts the ends of the lower and upper dies 12 and 14.

With the sealing ring 38 and sealing base elements 42, 44 and 46 stationary, the cylinder assembly 24 continues moving the housing 30 toward the end of the tube 20. Because the tapered element 32 is connected to the housing 30, the tapered element 32 moves further into the bore 60, and the tapered element 32 moves relative to the stationary sealing ring 38 and sealing base elements 42, 44 and 46. Additionally, the pad end 54 of spool retainer 52 moves toward the dies 12 and 14 within the spool retainer chamber 58. Because the housing 30 continues to move relative to the sealing ring 38 and sealing base elements 42, 44 and 46, the rubber spring 48 compresses and the compression gap 50 closes as illustrated in FIG. 2*d*.

As depicted in FIG. 2*d*, the cylinder assembly 24 pushes the tapered element 32 into the bore 60 until it reaches the sealing diameter 39. At the sealing diameter 39, the diameter of the tapered element 32 is slightly larger than inner diameter of the tube 20 causing the tapered element 32 to push against the wall of the tube 20 creating a tight seal between the tapered element 32 and the inner wall of the tube 20. Because the tapered element 32 pushes against the wall of the tube 20, the wall of the tube 20 in turn pushes against the sealing ring 38 creating another tight seal between the sealing ring 38 and the outer wall of the tube 20. Once the tight seals are formed, the cylinder assembly 24 holds the sealing unit 22 in the sealed position.

When sealing unit 22 is in the sealed position, the sealing unit 22 provides several sealing surfaces. The main sealing surface 41 is between the tapered element 32 and the inner wall of the tube 20. Because the tapered element 32 is inserted into the bore 60 up to its sealing diameter, the tapered element 32 pushes against the inner wall of the tube 20 sealably engaging the inner wall of the tube 20. The cylinder assembly 24 provides a force to maintain the tapered element in the sealed position within the bore 60 of the tube 20.

Another sealing surface exists between the sealing ring 38 and the outer wall of the tube 20. Because the inner diameter of the sealing ring 38 is equal or less than five thousandths of an inch larger than the outer diameter of the tube 20, a seal readily forms between these elements 20 and 38. When the tapered element 32 is inserted up to its sealing diameter, the tapered element 32 pushes the wall of the tube 20 against the sealing ring 38 resulting in slight flaring at the end of the tube 20. The tube 20 flaring outward against the sealing ring 38 closes any gap between the outer wall of the tube 20 and the sealing ring 38 providing a tight fluid seal.

With the sealing units 22 in the sealed position, the tube 20 may be filled with the forming fluid. In the preferred embodiment, the forming fluid is 95% water and 5% water additives including a cleaning agent, a lubricant and a rust inhibitor. The housing 30 and tapered element 32 have a central fluid passage 62 extending therethrough to a fluid inlet 64. A fluid control means (not shown) controls the flow of the forming fluid from a fluid supply chamber (not shown) through the central fluid passage 62, out the fluid inlet 64 and into the tube 20. The tight seal provided by the pair of sealing units 22 prevents the forming fluid from escaping the tube 20. Pressurizing the forming fluid exerts an internal pressure on the tube 20 causing the tube wall to expand and to fill the recesses of the cavity between the lower and upper dies 12 and 14. Because the cylinder assembly 24 maintains the position of the housing 30 and tapered element 32 with a force greater than that of the internal pressure in the tube 20, the sealing units 22 maintain the tight fluid seal.

Once the formed tube is created, the fluid control means depressurizes the forming fluid and returns the forming fluid to the fluid supply chamber. The fluid inlet 64 may be provided with a filter (not shown) to prevent any foreign material from corrupting the forming fluid supply. After the formed tube has been drained, the sealing units 22 release their sealing engagement, and the hydraulic cylinder assemblies 24 retract the sealing units away from the ends of the tube 20. The lower and upper dies 12 and 14 then separate to release the formed tube.

When the sealing unit 22 retracts from the sealed position, the cylinder assembly 24 pulls the housing 30 away from the end of the tube 20. Because the tapered element 32 is connected to the housing 30, the cylinder assembly 24 pulls the tapered element 32 from the bore 60 releasing the sealing engagement between the tapered element 32 and inner wall of the tube 20. Because housing 30 and tapered element 32 are capable of movement relative to the sealing ring 38 and base elements 42, 44 and 46, the sealing ring 38 and base elements 42, 44 and 46 remain stationary until the housing 30 retracts the spool retainer 52 into abutment with the pad element 42. When the flange on the pad end 54 of the spool retainer 52 abuts the pad element 42, the sealing ring 38 and sealing elements 42, 44 and 46 are pulled away from the end of the tube 20 releasing the sealing engagement between the sealing ring 38 and outer wall of the tube 20. The cylinder assembly 24 further retracts the piston rod 26 placing the sealing unit 22 in the retracted position.

In the preferred embodiment, the tapered element 32, sealing ring 38 and pad element 42 are composed of a hardened steel such as D2 steel which maintains its shape with minimal wear over repeated use. Repeated use of the sealing unit 22 subjects the tapered element 32, sealing ring 38 and pad element 42 to wear because of their frictional contact with tubes 20. Because the tapered element 32, sealing ring 38 and pad element 42 are composed of a metal stronger than the metal composing the tube 20, these elements 32, 38 and 42 have a long life before requiring replacement. Additionally, burrs on unfinished tubes will not damage the strong metal of the tapered element 32, sealing 38 and pad element 42 in contrast to the damage burrs cause to conventional O-rings.

In the preferred embodiment, the remaining elements of the sealing unit 22 which are not subject to frictional contact with the tube 20 are composed of standard, cheaper boiler plate steel. The preferred embodiment as illustrated in FIG. 2*a* also includes wear strips 66 between the housing 30 and the pad element 42 which move over each other. the wear strip 66 enables the housing 30 to easily slide on the pad element 42. In the preferred embodiment, the wear strip 66 is composed of an aluminum bronze with graphite plugs to reduce the friction between the housing 30 and pad element 42. A wear strip 66 is also positioned between the housing 30 and the sealing unit platform 68 to allow easily sealing unit 22 motion over the platform 68 reducing wear on the housing 30.

The preferred embodiment of FIGS. 2*a* through 2*d* provides for easy replacement of worn elements of the sealing unit 22. Because the housing 30 is attached to the tapered element 32 and spool retainer 52 by releasably threaded connections, the housing 30 may be disconnected and removed from the tapered element 32 and spool retainer 52. By removing the housing 30, the remaining elements of the sealing unit 22 may be removed and replaced. Any of the elements of the sealing unit 22 could be permanently connected to each other, but permanent connections between the elements of the sealing unit 22 inhibit repair and replacement of worn elements.

Figure 3A:
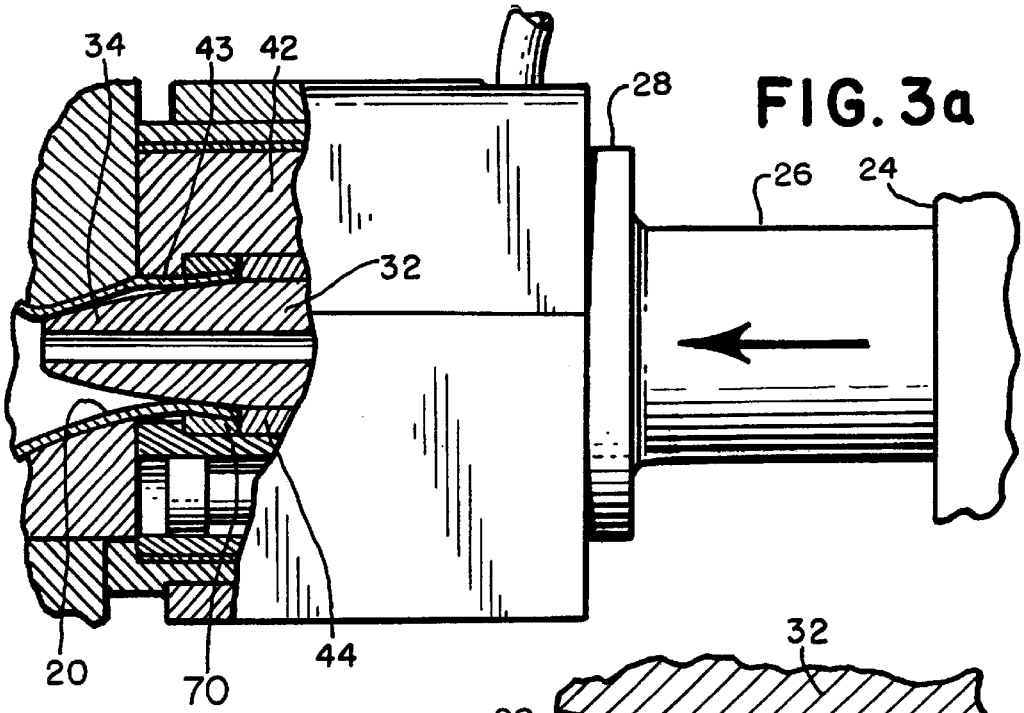
FIG. 3*a* is a side elevation view of another embodiment of the sealing unit with a tapered sealing ring.

FIG. 3*a* illustrates another embodiment of the sealing unit 22. This embodiment is similar to the above disclosed embodiment of FIG. 2*a* through 2*d*. The embodiment illustrated in FIG. 3*a* incorporates a tapered sealing ring 70 replacing the sealing ring 38 with the uniform diameter. In the embodiment of FIG. 3*a*, the housing 30, tapered element 32, sealing base elements 42, 44, 46, rubber springs 48 and spool retainers 52 all perform as described above. When moving the sealing unit 22 to the sealed position, the cylinder assembly 24 pushes the tapered element 32 into the bore 60 until it reaches the sealing diameter. At the sealing diameter, the diameter of the tapered element 32 is slightly larger than inner diameter of the tube 20 causing the tapered element 32 to push against the wall of the tube 20 creating a tight seal between the tapered element 32 and the inner wall of the tube 20. Because the tapered element 32 pushes against the wall of the tube 20, the wall of the tube 20 in turn pushes against the sealing ring 70 creating another tight seal between the sealing ring 70 and the outer wall of the tube 20.

Figure 3B:
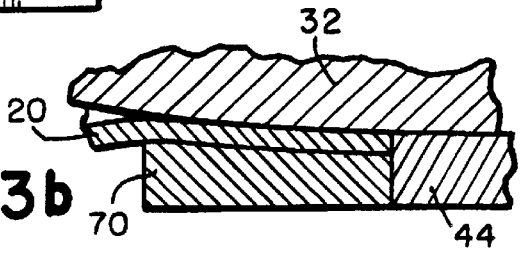
FIG. 3*b* is a side elevation view of the tapered sealing ring of FIG. 3*a*.

Because the sealing ring 70 is tapered, the tapered element 32 may be further inserted into the bore 60 allowing the tapered element 32 to further push the walls of the tube 20 against the sealing ring 70 creating a significant flare at the end of the tube 20. The flared end of the tube 20 creates a tight seal between the tapered element 32 and inner wall of the tube 20 and between the sealing ring 70 and the outer wall of the tube 20. Because the tapered sealing ring 70 creates a flared tube, the tapered sealing ring 38 provides a stronger seal than the sealing ring with a uniform diameter of FIG. 2*a* through FIG. 2*d*. The taper of the sealing ring 70 ideally matches the taper of the tapered element 32 to create a tight seal along the entire sealing ring 70 as shown in FIG. 3*b*. The taper of the sealing ring 70 may be linear or arced. One example of the tapered sealing ring 70 provides for hydroforming a 2.5 inch diameter blank tube with a 2 mil thickness. The sealing ring 70 would taper linearly at approximately a fifteen degree angle to provide a one inch flare at the end of the tube 20. The tapered sealing ring 70 would be used instead of the uniform sealing ring 38 in hydroforming applications that do not require axial feeding of additional material into the dies for large expansions of the tube 20.

Figure 4A:
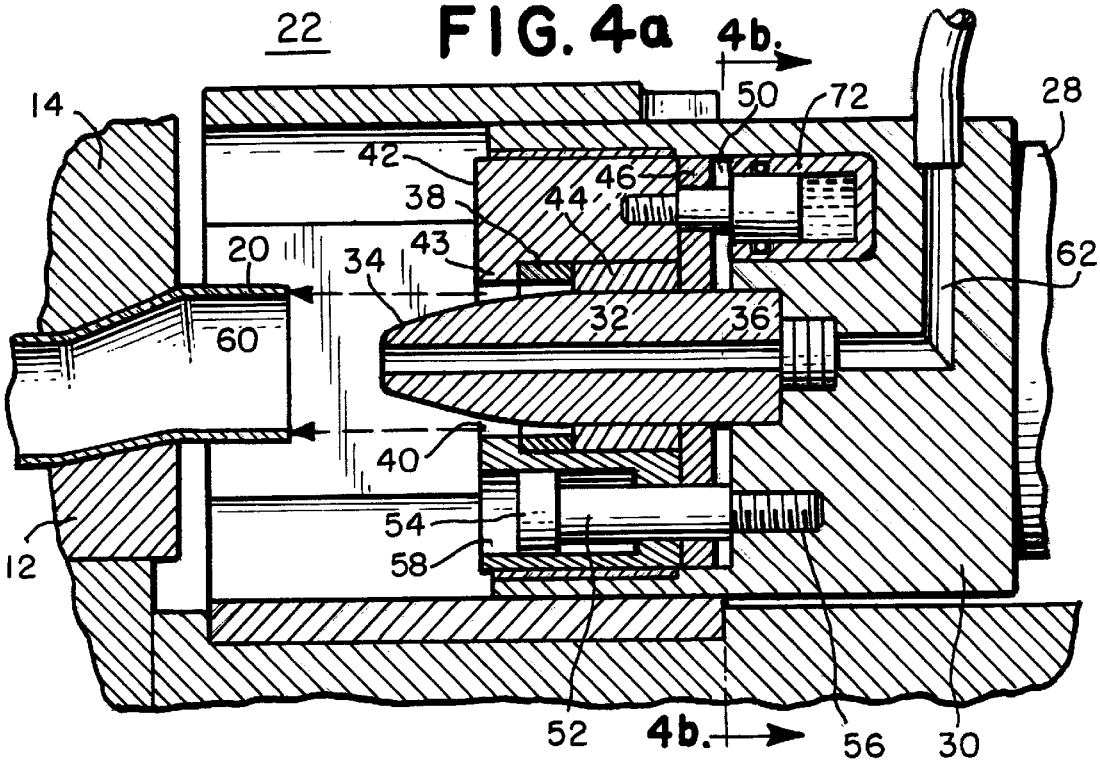
FIG. 4*a* is a side elevation view of an embodiment of the sealing unit with air piston.
Figure 4B:
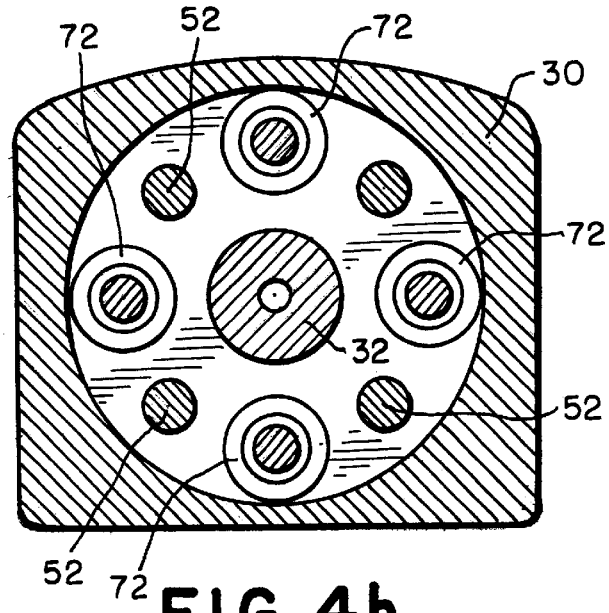
FIG. 4*b* is a end view of the sealing unit in FIG. 4*a* along line 4*b*—4*b*.

FIG. 4*a* illustrates another embodiment for the sealing unit 22. In this embodiment the stop element is an air cylinder 72 instead of the rubber stops 48 of FIGS. 2*a* through 2*d*. FIG. 4*a* illustrates the sealing unit 22 in the retracted position. Separating the backing plate 46 from the housing 30 is an air cylinder 72. The air cylinder 72 may be a nitrogen cylinder or any other known in the art. FIG. 4*b* illustrates the arrangement for the nitrogen cylinders 72. In this embodiment, four nitrogen cylinders 72 are equally spaced along the housing 30. The nitrogen cylinders 72 bias the backing plate 46, pad element 42, locking element 44, and sealing ring 38 away from the housing 30 creating a compression gap 50 between the housing 30 and the backing plate 46.

Figure 4C:
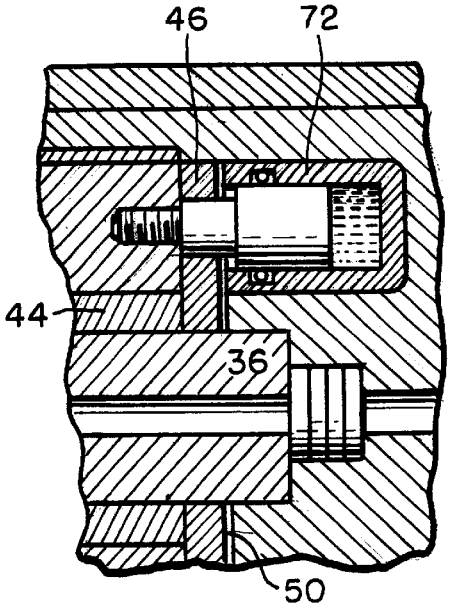
FIG. 4*c* is a side elevation view of the air piston in FIG. 4*a* in the sealed position.

FIG. 4*c* illustrates the sealing unit 22 with nitrogen cylinders 72 in the sealed position. The sealing unit 22 with nitrogen cylinders 72 replacing the rubber springs 48 performs similarly as the embodiment disclosed above in conjunction with FIGS. 2*c* and 2*d*. In the embodiment implementing nitrogen cylinders 72, when the sealing ring 38, pad element 42, locating element 44 and backing plate 46 are stationary and the housing 30 continues to move relative to the sealing ring 38 and sealing base elements 42, 44 and 46, the nitrogen cylinders 72 compress and the compression gap 50 closes. In comparison to the rubber spring 48, the nitrogen cylinder 72 compresses less readily. The nitrogen cylinders 72 would be implemented when a greater force is needed to seal the tube with the sealing unit such as for blank tubes 20 with larger wall thickness. Additionally, the nitrogen cylinders 72 do not wear as quickly as rubber springs 48, so nitrogen cylinders are suitable for higher production volume hydroforming.

While particular embodiments and applications of the present invention have been illustrated and described, it is to be understood that the invention is not limited to the precise construction and compositions disclosed herein and that various modifications, changes, and variations will be apparent from the foregoing descriptions without departing from the spirit and scope of the invention as defined in the appended claims.

What is claimed is:

1. A sealing unit for sealing an end of a tube, said tube having an outer wall and a bore defined by an inner wall, said sealing unit comprising:

a tapered element adapted for insertion into said bore, said tapered element having a longitudinal axis;

a metallic sealing ring having a cylindrical inside wall configured to fit closely around the outer wall of the end of said tube, said inside wall being co-axial with said longitudinal axis of said tapered element to provide an annular channel between said tapered element and said inside wall of said sealing ring, said annular channel having an open end and a closed end, said annular channel capable of receiving said end of said tube through said open end of said annular channel; and a base for holding said sealing ring in place, said base defining said closed end of said annular channel, said tapered element for wedging against said inner wall of said tube to provide a seal between said tapered element and said tube, said inside wall of said sealing ring having a uniform inner radius so as to prevent outward distortion of the outer wall of the end of said tube.

2. The sealing unit of claim 1 wherein when said end of said tube being positioned within said annular channel and said base stationary relative said tube, said tapered element being capable of sliding further into said bore until said tapered element sealably engages said inner wall of said tube.

3. The sealing unit of claim 2 wherein when said tapered element being in sealable engagement with said inner wall of said tube, said tapered element forces said inner wall of said tube outward to also provide a sealable engagement between said sealing ring and said outer wall of said tube.

4. The sealing unit of claim 1 wherein said tapered element has an insertion end having an insertion diameter and a housing end having a sealing diameter, said insertion diameter being smaller than an inner diameter of said tube and said sealing diameter being larger than said inner diameter of said tube, the diameter of said tapered element gradually increasing from said insertion and to said housing end.

5. The sealing unit of claim 1 wherein said tapered element is a paraboloid.

6. The sealing unit of claim 1 wherein said tapered element is a frustum of a right circular cone.

7. The sealing unit of claim 1 wherein said tapered element has a passage therethrough extending in said insertion end for supplying hydroforming liquid into said tube.

8. The sealing unit of claim 1 wherein said sealing ring is held in place by said base.

9. The sealing unit of claim 1 wherein said tapered element is composed of a hardened steel.

10. The sealing unit of claim 1 wherein said tapered element is composed of D2 steel.

11. The sealing unit of claim 1 wherein said sealing ring is composed of a hardened steel.

12. The sealing unit of claim 1 wherein said sealing ring is composed of D2 steel.

13. The sealing unit of claim 1 wherin when said sealing engagement with said end of tube, said sealing unit withstands a range of tube pressures, in the range from 500 to 10,000 pounds per square inch.

14. The sealing unit of claim 1, further comprising:

a housing, said tapered element having an insertion end and a housing end, said housing end of said tapered element connected to said housing, said base having a front end and a back end; and at least one stop element abutting said back end of said base and abutting said housing to separate said housing from said back end of said base, when said end of said tube being positioned within said annular channel and said base stationary relative said tube, said housing being capable of sliding toward said stationary base compressing said stop element and said tapered element being capable of sliding further into said bore until said tapered element sealably engaging said inner wall of said tube.

15. The sealing unit of claim 14 wherein when said tapered element being in sealable engagement with said inner wall of said tube, said tapered element forces said inner wall of said tube outward providing sealable engagement between said sealing ring and said outer wall of said tube.

16. The sealing unit of claim 14 wherein said stop element is a rubber spring.

17. The sealing unit of claim 14 wherein said stop element is an air piston.

18. The sealing unit of claim 14 further including a spool retainer, said spool retainer having a base end moveable within a spool retainer chamber in said base, said spool retainer having a housing end connected to said housing, said base end of said spool retainer moving within said spool retainer chamber when said housing sliding relative to said base, said base end having a stop flange, said stop flange abutting base to limit the sliding of said housing relative to said base.

19. The sealing unit of claim 14 further comprising a moving means connected to said housing, said sealing unit moving means capable of moving said sealing unit between a retracted position and a sealed position, in said retracted position said sealing unit positioned away from said end of said tube, in said sealed position said sealing unit sealably engaging said end of said tube.

20. The sealing unit of claim 19 wherein said moving means comprises a hydraulic cylinder assembly having a piston rod connected to said housing.

21. In an apparatus for forming a complex-shaped frame member from a blank tube positioned in a cavity between a pair of dies, said tube having an outer wall and having a bore therethrough defined by an inner wall and having a first end and a second end, a pair of sealing units for sealing engagement with said opposed ends of said tube and for communicating fluid into said tube, comprising:

a tapered element adapted for insertion into said bore and having a longitudinal axis;

a metallic sealing co-axial with said longitudinal axis of said tapered element to provide an annular channel between said tapered element and said sealing ring, said annular channel having an open end and a closed end, said annular channel capable of receiving said first end of said tube through said open end of said annular channel; and a base co-axial with said longitudinal axis of said tapered element, said base contacting said sealing ring to hold said sealing ring in place, said base contacting said tapered element to terminate said annular channel at said closed end, when said sealing unit is in sealing engagement with said end of said tube, said tapered element sealably wedged against said inner wall of said tube and said sealing ring sealably engaging said outer wall of said tube and preventing the end of said tube from being distorted out.

22. The apparatus of claim 21 wherein when said first end of said tube being positioned within said annular channel and said base stationary relative said tube, said tapered element being capable of sliding further into said bore until said tapered element sealably engaging said inner wall of said tube.

23. The apparatus of claim 22 wherein when said tapered element being in sealing engagement with said inner wall of said tube, said tapered element forces said inner wall of said tube outward providing a further sealing engagement between said sealing ring and said outer wall of said tube.

24. The apparatus of claim 21 wherein said tapered element has an insertion end having an insertion diameter and a housing end having a sealing diameter, said insertion diameter being smaller than an inner diameter of said tube and said sealing diameter being larger than said inner diameter of said tube.

25. The apparatus of claim 21 wherein said tapered element is a paraboloid.

26. The apparatus of claim 21 wherein said tapered element is a frustum of a right circular cone.

27. The apparatus of claim 21 wherein said sealing ring is a cylindrical ring having a uniform inner radius.

28. The apparatus of claim 21 wherein said sealing ring is a cylindrical ring with a tapered inner radius.

29. The apparatus of claim 21 wherein said tapered element is composed of a hardened steel.

30. The apparatus of claim 21 wherein said tapered element is composed of D2 steel.

31. The apparatus of claim 21 wherein said sealing ring is composed of a hardened steel.

32. The apparatus of claim 21 wherein said sealing ring is composed of D2 steel.

33. The sealing unit of claim 21 wherein when said sealing unit is in sealing engagement with said first end of said tube, said sealing unit withstands a range of tube pressures, said range of tube pressures is 500 to 10,000 pounds per square inch.

34. The apparatus of claim 21, further comprising:

a housing, said tapered element having an insertion end and a housing end, said housing end of said tapered element connected to said housing, said base having a front end and a back end; and at least one stop element abutting said back end of said base and abutting said housing to separate said housing from said back end of said base, when said first end of said tube being positioned within said annular channel and said base stationary relative said tube, said housing being capable of sliding toward said stationary base compressing said stop element and said tapered element being capable of sliding further into said bore until said tapered element sealably engaging said inner wall of said tube.

35. The apparatus of claim 34 wherein when said tapered element being in sealable engagement with said inner wall of said tube, said tapered element forces said inner wall of said tube outward providing sealable engagement between said sealing ring and said outer wall of said tube.

36. The apparatus of claim 34 wherein said stop element is a rubber spring.

37. The apparatus of claim 34 wherein said stop element is an air piston.

38. The apparatus of claim 34 further including a spool retainer, said spool retainer having a base end moveable within a spool retainer chamber in said base, said spool retainer having a housing end connected to said housing, said base end of said spool retainer moving within said spool retainer chamber when said housing sliding relative to said base, said base end having a stop flange, said stop flange abutting base to limit the sliding of said housing relative to said base.

39. The apparatus of claim 34 further comprising moving means connected to said housing, said moving means capable of moving said sealing unit between a retracted position and a sealed position, in said retracted position said sealing unit positioned away from said first end of said tube, in said sealed position said sealing unit sealably engaging said first end of said tube.

40. The apparatus of claim 39 wherein said moving means is a hydraulic cylinder assembly having a piston rod connected to said housing.

41. The apparatus of claim 21 wherein said sealing unit further including a fluid communication means for introducing a forming fluid through said sealing unit into said tube.

42. The apparatus of claim 41 wherein said fluid communication means includes a fluid passage extending through said tapered element.

43. A method for sealing the end of a tube having an outer wall and a bore therethrouph defined by an inner wall and held between dies of a hydroforming press said method comprising the steps of:

(a) moving a housing containing an annular element and a tapered element having an insertion end and a housing end, said housing end attached to said housings, said tapered element extending into said annular element and toward said dies to force the insertion end of said tapered element into said bore of said tube;

(b) stopping the movement of the annular element while the housing continues to move the tapered element further into the bore to create a seal between said tapered element and the inner wall of said tube;

(c) stopping the movement of the movement of the housing.

44. The method of claim 43 further comprising a step of cushioning the movement of said tapered element after the movement of the annular element is stopped.

45. The method of claim 44 further comprising a step of moving said housing away from said dies.

46. Apparatus for sealing an end of a tube having a bore therethrough defined by an inner wall and having an outer wall, said tube being held between two dies, said apparatus comprising:

a housing having a front side and a back side and a recess in said front side;

an annular element fitting within said recess;

a metallic sealing ring coaxial with said annular element, said sealing ring fitting inside of said annular element;

a tapered element coaxial with said sealing ring, said tapered element having an insertion end and a housing end, the housing end being attached to said housing, the insertion end fitting inside said annular element and extending past the sealing element so as to define with the sealing ring an annular channel for receiving the tube;

means for moving said housing toward the dies to place said annular element in contact with said dies and to move said tapered element with respect to the annular element to establish a seal between the inner wall of said tube and said tapered element; and, at least one stop element interposed between said housing and the annular element to cushion movement of said tapered element after the annular element reaches said dies.

47. The apparatus of claim 46 further comprising a spool retainer attached to said housing and extending into said annular element for pulling said annular element away from said dies.

48. The apparatus of claim 46 wherein the stop element is a rubber.

49. The apparatus of claim 46 wherein the stop element is an air piston.

50. The apparatus of claim 46 wherein the seal withstands tube pressures in the range from 500 to 10,000 pounds per square inch.

51. The apparatus of claim 46 wherein the sealing ring is made of tempered steel.

52. The apparatus of claim 46 wherein the sealing ring is made of D2 steel.

* * * * *

UNITED STATES PATENT AND TRADEMARK OFFICE

CERTIFICATE OF CORRECTION

PATENT NO. : 6,502,822 B1
DATED : January 7, 2003
INVENTOR(S) : James H. Brown

It is certified that error appears in the above-identified patent and that said Letters Patent is hereby corrected as shown below:

Column 15,
Line 58, delete “therethrouph” and insert -- therethrough --.

Signed and Sealed this

Sixth Day of May, 2003

JAMES E. ROGAN
*Director of the United States Patent and Trademark Office*